US008957775B2

(12) United States Patent
Yen

(10) Patent No.: US 8,957,775 B2
(45) Date of Patent: Feb. 17, 2015

(54) ELECTRONIC DEVICE AND WIRELESS CONTROL METHOD

(71) Applicant: Chi Mei Communication Systems, Inc., New Taipei (TW)

(72) Inventor: Chien-Yi Yen, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 172 days.

(21) Appl. No.: 13/771,123

(22) Filed: Feb. 20, 2013

(65) Prior Publication Data

US 2013/0229266 A1 Sep. 5, 2013

(30) Foreign Application Priority Data

Mar. 1, 2012 (TW) ..... 101106837 A

(51) Int. Cl.
*G08B 1/08* (2006.01)
*G08C 17/02* (2006.01)

(52) U.S. Cl.
CPC ..... *G08C 17/02* (2013.01); *G08C 2201/93* (2013.01)
USPC ..... 340/539.11; 340/539.1; 340/825.69; 340/825.72

(58) Field of Classification Search
USPC ..... 340/539.1, 539.11, 539.25, 384.7, 12.5, 340/825.69, 825.72; 455/41.1, 67.11, 455/414.1, 422.1, 456.1, 456.3; 700/1, 17
See application file for complete search history.

(56) References Cited

U.S. PATENT DOCUMENTS 7,127,271 B1 * 10/2006 Fujisaki ..... 455/556.1
7,197,364 B2 * 3/2007 Chernoff et al. ..... 700/9
2008/0001732 A1 * 1/2008 Ober ..... 340/539.17

* cited by examiner

*Primary Examiner* — Hung T Nguyen
(74) *Attorney, Agent, or Firm* — Novak Druce Connolly Bove + Quigg LLP

(57) ABSTRACT

In a wireless control method, functional components that can be wirelessly controlled in an electronic device are set to be remote control components. A wireless control means of each of the remote control components and functions of each of the remote control components are preset. The method determines a remote control component that is currently working in the electronic device. The method further receives a wireless control signal by the electronic device, and executes a function of the determined remote control component, when the received wireless control signal is used to perform the wireless control means of the determined remote control component.

18 Claims, 4 Drawing Sheets

ELECTRONIC DEVICE AND WIRELESS CONTROL METHOD

BACKGROUND

1. Technical Field

Embodiments of the present disclosure relate to controlling technology, and particularly to an electronic device and wireless control method using the electronic device.

2. Description of Related Art

An electronic device, such as a communication device, may have multiple hardware components and software applications. Generally, the hardware components and software applications are operated by a user through a hardware device (e.g., a keyboard and a touch panel) or user interfaces provided by the software applications. When the user needs to operate the electronic device, the user has to handhold the electronic device or stand close to the electronic device. Thus, it is inconvenient for the user to control the electronic device. Therefore, an efficient wireless control method using the electronic device is desired.

DETAILED DESCRIPTION

All of the processes described below may be embodied in, and fully automated via, functional code modules executed by one or more general purpose electronic devices or processors. The code modules may be stored in any type of non-transitory computer-readable medium or other storage device. Some or all of the methods may alternatively be embodied in specialized hardware. Depending on the embodiment, the non-transitory computer-readable medium may be a hard disk drive, a compact disc, a digital video disc, a tape drive or other suitable storage medium.

Figure 1:
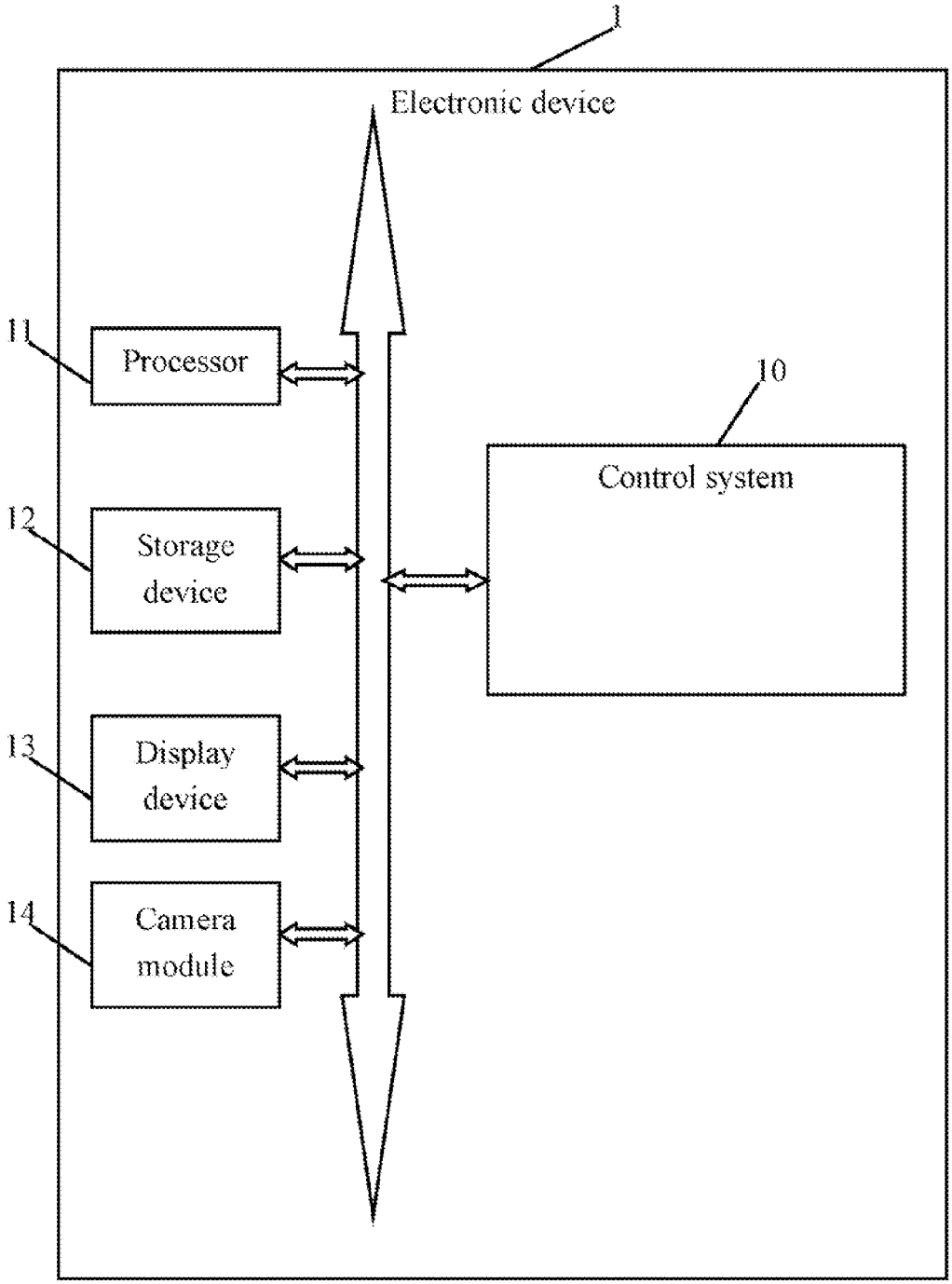
FIG. 1 is a block diagram of one embodiment of an electronic device including a control system.

FIG. 1 is a block diagram of one embodiment of an electronic device 1 including a control system 10. The electronic device 1 further includes at least one processor 11, a storage device 12, a display device, and a camera module 14. FIG. 1 illustrates only one example of the electronic device 1 that may include more or fewer components than illustrated, or have a different configuration of the various components in other embodiments.

In some embodiments, the electronic device 1 may be a mobile phone, a tablet computer, a personal digital assistant, a notebook computer, or any other device. The electronic device 1 may include a plurality of functional components, which may be hardware components or software units. For example, the functional components may include, but are not limited to the camera module 14, a music player, a multimedia application, a calendar application, a recorder, and any other functional components not shown in FIG. 1.

The control system 10 is used to control specified functional components remotely using a predetermined wireless control means. A detailed description of the control system 10 will be given in the following paragraphs.

In one embodiment, the control system 10 may include computerized instructions in the form of one or more programs that are executed by the at least one processor 11 and stored in the storage device 12. The storage device 12 stores one or more programs, such as operating systems, applications of the electronic device 1, and various kinds of data, such as songs. In some embodiments, the storage device 12 may be an external storage card, such as a memory stick, a smart media card, a compact flash card, a secure digital card, or any other type of memory storage device.

The display device 13 may display data in visible form, such as images, and messages. In some embodiments, the display device 13 may be a touch panel. The camera module 14 is used to capture images.

Figure 2:
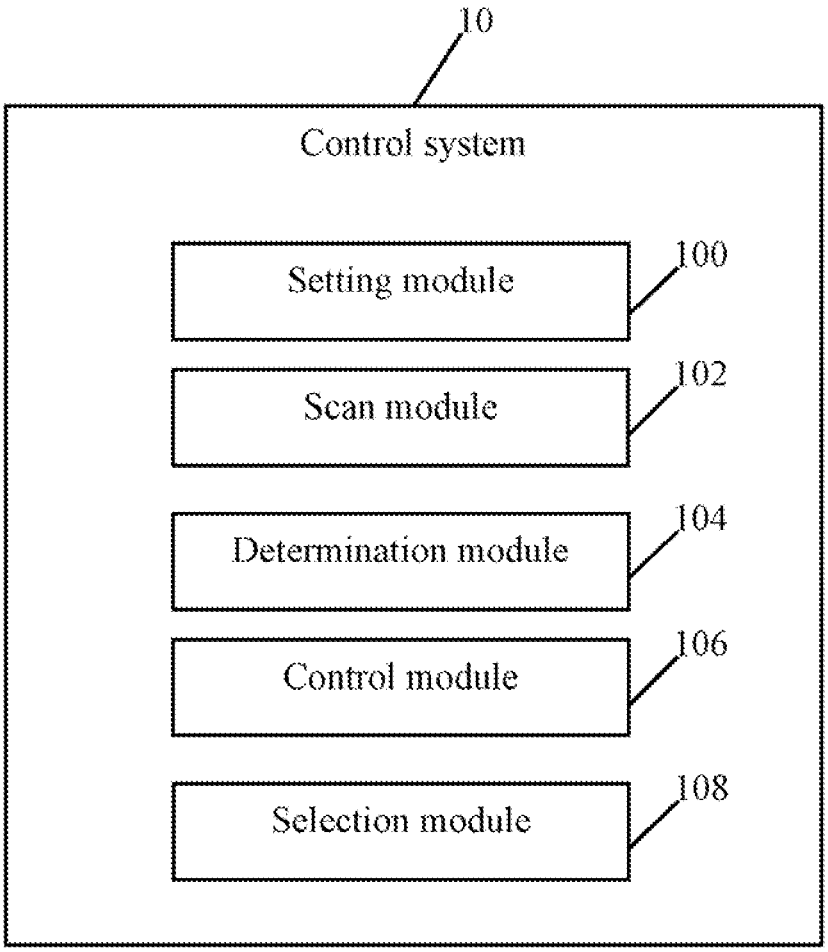
FIG. 2 is a block diagram of function modules of the control system in the electronic device.

FIG. 2 is a block diagram of function modules of the control system 10 included in the electronic device 1. In one embodiment, the control system 10 may include one or more modules, for example, a setting module 100, a scan module 102, a determination module 104, a control module 106, and a selection module 108. In general, the word "module", as used herein, refers to logic embodied in hardware or firmware, or to a collection of software instructions, written in a programming language, such as, Java, C, or assembly. One or more software instructions in the modules may be embedded in firmware, such as in an EPROM. The modules described herein may be implemented as either software and/or hardware modules and may be stored in any type of non-transitory computer-readable medium or other storage device. Some non-limiting examples of non-transitory computer-readable medium include CDs, DVDs, BLU-RAY, flash memory, and hard disk drives.

Figure 4:
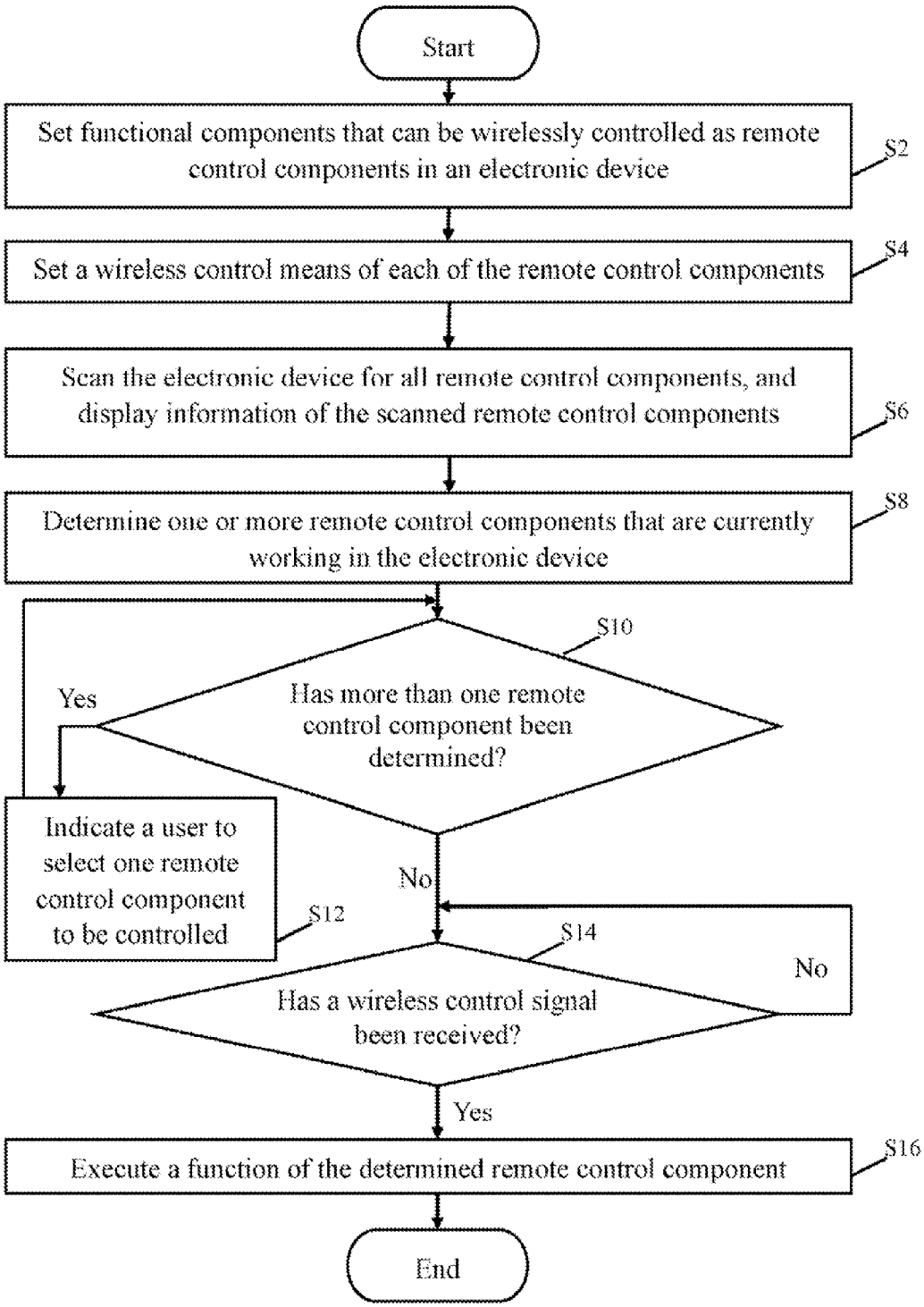
FIG. 4 is a flowchart of one embodiment of a wireless control method using the control system.

FIG. 4 is a flowchart of one embodiment of a wireless control method using the control system 10. Depending on the embodiment, additional steps may be added, others removed, and the ordering of the steps may be changed.

In step S2, the setting module 100 sets functional components that can be wirelessly controlled as remote control components. For example, the functional components may include the camera module 14, the music player, the multimedia application, the calendar application, and the recorder in the electronic device 1.

In step S4, the setting module 100 sets a wireless control means of each of the remote control components, and sets optional functions of each of the remote control components. In some embodiments, the wireless control means is used to activate a corresponding remote control component, or execute one or more specified functions of the corresponding remote control component. For example, the wireless control means is correlated to the remote control component or the specified function(s) of the remote control component using the setting module 100.

In other embodiments, more than one wireless control means may be preset to correspond to each of the remote control components. For example, the more than one wireless control means may be used to activate the corresponding remote control component, or execute the specified function(s) of the corresponding remote control component.

In some embodiments, the wireless control means may be, but is not limited to a signal control means, a message control means, an email control means, or a phone control means.

The signal control means may be performed by pressing a predetermined keystroke on a predetermined component (e.g., a wireless earphone) in the electronic device 1, or by establishing a connection link between the predetermined component or a target electronic device and the electronic device 1, or by sending preset data (e.g., a preset control command) from the predetermined component or the target electronic device to the electronic device 1 through the connection link. The target electronic device is predetermined before establishing the connection link between the electronic device 1 and the target electronic device. For example, the preset control command may include predetermined keywords, such as "activate recorder."

For example, it is assumed that the signal control means is preset to correspond to a selection function of the music player. When the music player is running in the electronic device 1, the user of the electronic device 1 may select songs in the music player (e.g., a next song or a previous song) using multiple keystrokes on the wireless earphone of the electronic device 1. In the embodiment, a first keystroke on the wireless earphone may be pressed to control the music player to select the next song, and a second keystroke on the wireless earphone may be pressed to select the previous song. In another embodiment, the signal control means may be preset to correspond to a volume control function of the music player.

For another example, as more than one wireless control means may be preset to control one of the remote control components, such as, a first wireless control means to activate the camera module 14, a second wireless control means to capture an image using the camera module 14, and a third wireless control means to store the captured image. The first wireless control means is performed when the wireless earphone is connected to the electronic device 1, the second wireless control means is performed when the preset data is sent from the wireless earphone to the electronic device 1, and the third wireless control means is performed when the predetermined keystroke on the wireless earphone is pressed.

As mentioned above, as the signal control means has different kinds, the setting module 100 may set different kinds of signal control means to correspond to different functions of each of the remote control components.

The message control means is performed by sending a preset control message to the electronic device 1. The email control means is performed by sending a preset control email to the electronic device 1. Formats and keywords of the preset control message and the preset control email are preset. The preset control message or the preset control email may be sent by specified senders or any sender. The specified senders may be preset according to phone numbers, or email addresses. The preset control message or the preset control email may have different keywords to perform different functions of the remote control components. For example, a preset control message of "activate camera" may be used to activate the camera module 14 of the electronic device 1.

The phone control means is performed by making a phone call to the electronic device 1 from a specified caller.

In step S6, the scan module 104 scans the electronic device 1 for all of the remote control components in the electronic device 1, and displays a name and functions of each of the scanned remote control components on the display device 13. For example, a scanned remote control component is the recorder, a name of "recorder" and functions of "activate" and "disable" of the recorder are displayed. According to displayed information, the user may learn the wireless control means corresponding to the remote control components.

In step S8, the determination module 104 determines remote control components that are currently working in the electronic device 1.

In step S10, the determination module 104 determines whether there are one or more remote control components being worked in the electronic device 1.

If more than one remote control component is working, in step S12, the selection module 108 outputs a prompt to indicate to the user to select one remote control component to be controlled wirelessly, and the procedure returns to step S10.

If one remote control component is working, in step S14, the control module 106 determines whether a wireless signal to perform a wireless control means of the remote control component is received from the predetermined component (e.g., the wireless earphone as mentioned above) of the electronic device 1 or the target electronic device (e.g., another electronic device). For example, when the user wants to control the remote control component using a corresponding wireless control means, the user may press a keystroke on the wireless earphone to send the wireless signal, and the control module 106 receives the wireless signal from the wireless earphone, and determines whether the received wireless signal corresponds to one of the wireless control means of the remote control component.

If no wireless signal to perform the wireless control means of the remote control component is received, step S14 is repeated.

If the wireless signal to perform the wireless control means of the remote control component is received, in step S16, the determination module 104 displays a user interface of the remote control component on the display device 13, and the control module 106 executes a function of the remote control component, the executed function corresponds to the wireless control means. The user interface may provide the functions of the remote control component. In some embodiments, the control module 106 may delay to execute the function for a predetermined time interval (e.g., 10 seconds), thus, the user may have time to prepare before the function is executed. In the embodiment, when the function is used to capture an image using the camera module 14, the user may pose during the delay procedure.

In other embodiments of FIG. 4, step S6 may be omitted. When the wireless control means are the message/email/phone control means, step S14 may be further implemented to recognize keywords, senders or other parameters of the received wireless signal by the control module 106.

Figure 3:
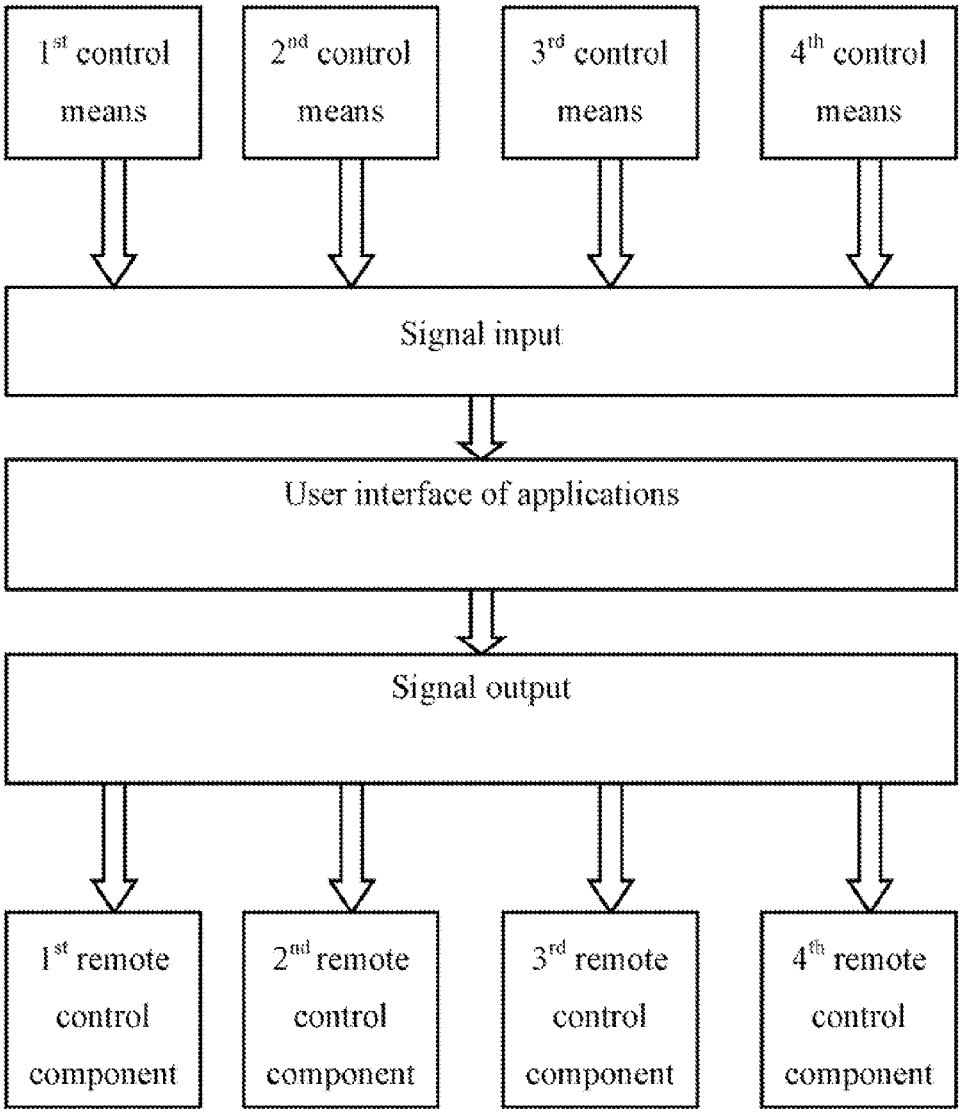
FIG. 3 is a schematic diagram of one embodiment of a signal transmission procedure.

As referred to FIG. 3, different kinds of wireless control means may be performed by sending different kinds of signals to the electronic device 1. By utilizing the control system 10, the signals are input to a user interface of an application (e.g., one of the remote control components), and the signals are analyzed and output to control corresponding remote control components.

It should be emphasized that the above-described embodiments of the present disclosure, particularly, any embodiments, are merely possible examples of implementations, set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A computer-implemented wireless control method using a first electronic device, the first electronic device comprising a plurality of functional components and at least one processor, the method comprising:

setting functional components that can be wirelessly controlled as remote control components;

setting a wireless control means of each of the remote control components, and setting functions of each of the remote control components;

determining a remote control component that is currently working in the first electronic device;

receiving a wireless control signal by the at least one processor from a predetermined component in the first electronic device or a second electronic device; and executing a function of the determined remote control component using the at least one processor, when the received wireless control signal is used to perform the wireless control means of the determined remote control component.

2. The method according to claim 1, further comprising:

scanning the first electronic device for all of the remote control components in the first electronic device; and displaying a name and functions of each of the scanned remote control components on a display device of the first electronic device.

3. The method according to claim 1, further comprising:

outputting a prompt to indicate to a user to select one remote control component to be controlled wirelessly, when more than one remote control component is currently working in the first electronic device.

4. The method according to claim 1, wherein the remote control components comprise a camera module, a music player, a multimedia application, a calendar application, and a recorder, and the wireless control means is a signal control means, a message control means, an email control means, or a phone control means.

5. The method according to claim 4, wherein the predetermined component is a wireless earphone of the first electronic device, the signal control means is performed by pressing a keystroke on the wireless earphone, or by establishing a connection link between the wireless earphone or the second electronic device and the first electronic device, or by sending preset data from the wireless earphone or the second electronic device to the first electronic device through the connection link.

6. The method according to claim 4, wherein the message control means is performed by sending a preset control message to the first electronic device, the email control means is performed by sending a preset control email to the first electronic device, and the phone control means is performed by making a phone call to the first electronic device from a specified caller.

7. An electronic device, comprising:

a plurality of functional components;

a storage device;

at least one processor; and one or more modules that are stored in the storage device and are executed by the at least one processor, the one or more modules comprising:

a setting module that sets functional components that can be wirelessly controlled as remote control components, sets a wireless control means of each of the remote control components, and sets functions of each of the remote control components;

a determination module that determines a remote control component that is currently working in the electronic device; and a control module that receives a wireless control signal from a predetermined component in the electronic device or a target electronic device, and executes a function of the determined remote control component, when the received wireless control signal is used to perform the wireless control means of the determined remote control component.

8. The electronic device according to claim 7, wherein the one or more modules further comprises a scan module that scans the electronic device for all of the remote control components in the electronic device, and displays a name and functions of each of the scanned remote control components on a display device of the electronic device.

9. The electronic device according to claim 7, wherein the one or more modules further comprises a selection module that outputs a prompt to indicate to a user to select one remote control component to be controlled wirelessly when more than one remote control component is currently working in the electronic device.

10. The electronic device according to claim 7, wherein the remote control components comprise a camera module, a music player, a multimedia application, a calendar application, and a recorder, and the wireless control means is a signal control means, a message control means, an email control means, or a phone control means.

11. The electronic device according to claim 10, wherein the predetermined component is a wireless earphone of the electronic device, the signal control means is performed by pressing a keystroke on the wireless earphone, or by establishing a connection link between the wireless earphone or the target electronic device and the electronic device, or by sending preset data from the wireless earphone or the target electronic device to the electronic device through the connection link.

12. The electronic device according to claim 10, wherein the message control means is performed by sending a preset control message to the electronic device, the email control means is performed by sending a preset control email to the electronic device, and the phone control means is performed by making a phone call to the electronic device from a specified caller.

13. A non-transitory storage medium having stored thereon instructions that, when executed by a processor of a first electronic device, causes the first electronic device to perform a wireless control method using the first electronic device, the first electronic device comprising a plurality of functional components, the method comprising:

setting functional components that can be wirelessly controlled as remote control components;

setting a wireless control means of each of the remote control components, and setting functions of each of the remote control components;

determining a remote control component that is currently working in the first electronic device;

receiving a wireless control signal by the at least one processor from a predetermined component in the first electronic device or a second electronic device; and executing a function of the determined remote control component using the at least one processor, when the received wireless control signal is used to perform the wireless control means of the determined remote control component.

14. The non-transitory storage medium according to claim 13, wherein the method further comprises:

scanning the first electronic device for all of the remote control components in the first electronic device; and displaying a name and functions of each of the scanned remote control components on a display device of the first electronic device.

15. The non-transitory storage medium according to claim 13, wherein the method further comprises:

outputting a prompt to indicate to a user to select one remote control component to be controlled wirelessly, when more than one remote control component is currently working in the first electronic device.

16. The non-transitory storage medium according to claim 13, wherein the remote control components comprise a camera module, a music player, a multimedia application, a calendar application, and a recorder, and the wireless control means is a signal control means, a message control means, an email control means, or a phone control means.

17. The non-transitory storage medium according to claim 16, wherein the predetermined component is a wireless earphone of the first electronic device, the signal control means is performed by pressing a keystroke on the wireless earphone, or by establishing a connection link between the wireless earphone or the second electronic device and the first electronic device, or by sending preset data from the wireless earphone or the second electronic device to the first electronic device through the connection link.

18. The non-transitory storage medium according to claim 16, wherein the message control means is performed by sending a preset control message to the first electronic device, the email control means is performed by sending a preset control email to the first electronic device, and the phone control means is performed by making a phone call to the first electronic device from a specified caller.

* * * * *